United States Patent [19]

LaMantia

[11] Patent Number: 4,945,584

[45] Date of Patent: Aug. 7, 1990

[54] CRIB COVER

[75] Inventor: Mark A. LaMantia, Methuen, Mass.

[73] Assignee: Tots-In-Mind, Inc., No. Andover, Mass.

[21] Appl. No.: 185,483

[22] Filed: Apr. 25, 1988

[51] Int. Cl.[5] ..... A47D 7/100

[52] U.S. Cl. ..... 5/97; 5/414; 135/90; 135/104

[58] Field of Search ..... 5/97, 508, 100, 113, 5/414, 93 R; 135/104, 90

[56] References Cited

U.S. PATENT DOCUMENTS

| | | | |
|---|---|---|---|
| 2,820,468 | 1/1958 | Park et al. | 135/96 |
| 2,883,678 | 4/1959 | Heffernan et al. | 5/97 X |
| 2,927,331 | 3/1960 | Ruiz | 5/97 X |
| 3,546,721 | 12/1970 | Cleary | 5/97 |
| 4,015,297 | 4/1977 | Christian | 5/97 |
| 4,043,349 | 8/1977 | Gays et al. | 5/97 |
| 4,073,017 | 2/1978 | Stevens | 5/97 |
| 4,590,956 | 5/1986 | Griesenbeck | 135/119 X |
| 4,694,516 | 9/1987 | Overman, Sr. et al. | 5/97 X |
| 4,745,936 | 5/1988 | Scherer | 135/104 |
| 4,790,340 | 12/1988 | Mahoney | 135/104 X |

*Primary Examiner*—Alexander Grosz
*Assistant Examiner*—Michael Milano
*Attorney, Agent, or Firm*—Wolf, Greenfield & Sacks

[57] ABSTRACT

A cover for a crib or playpen includes a tent-like canopy having a pair of panels extending downwardly from two opposite ends which lie against the inside of a pair of sides of the crib or playpen and are tied in place by straps which extend about the sides. The cover leaves the other sides of the crib or playpen exposed. Ties are provided along the other side edges of the canopy for securing those edges to the tops of those sides.

16 Claims, 3 Drawing Sheets

FIG. 2
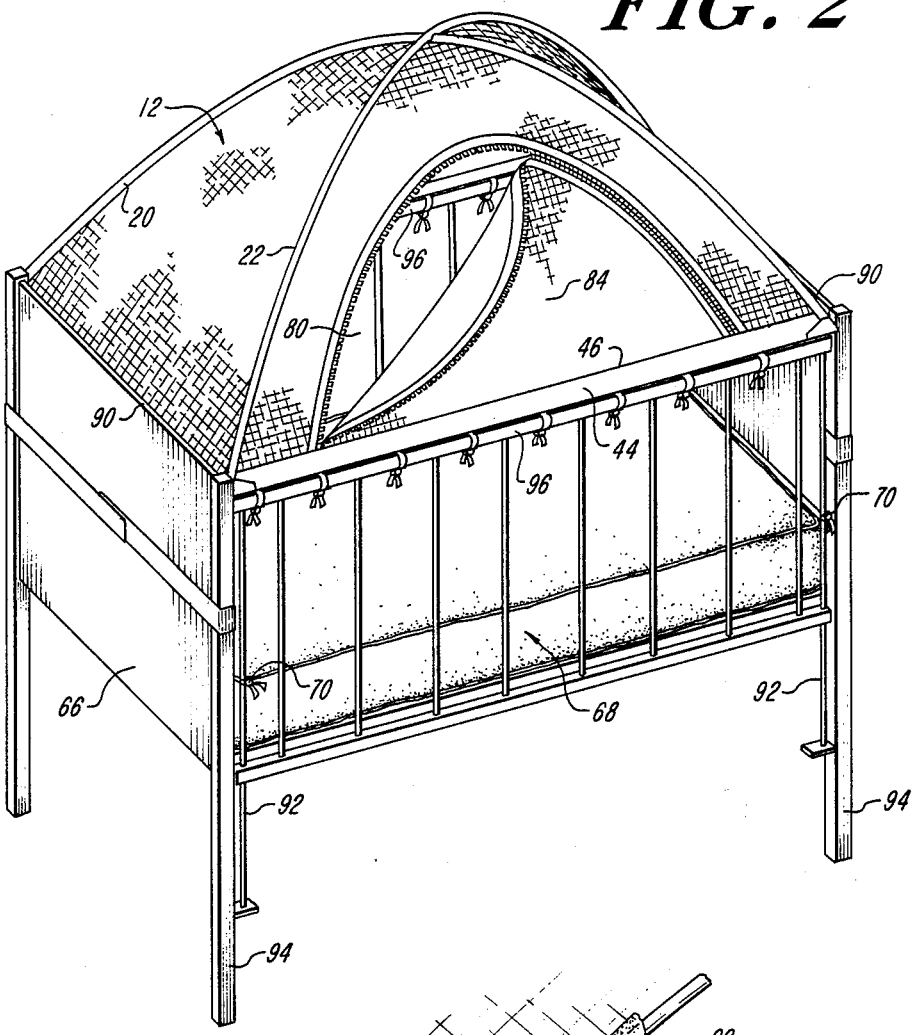
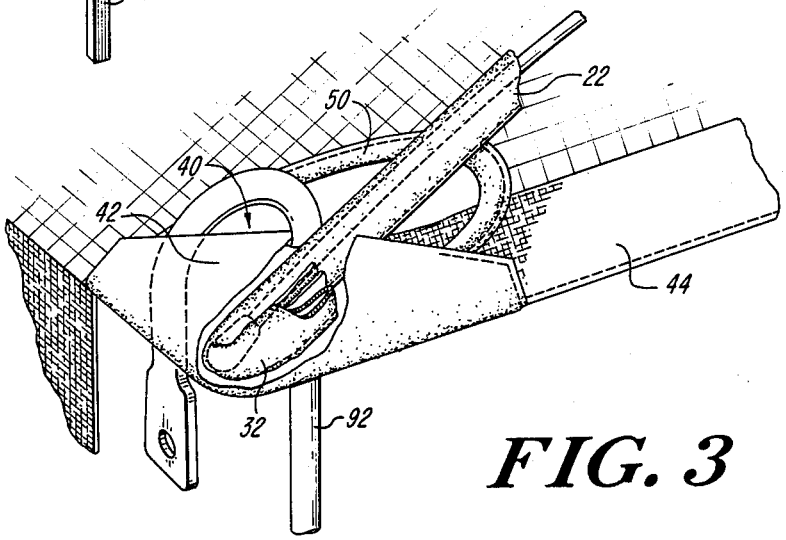
FIG. 3

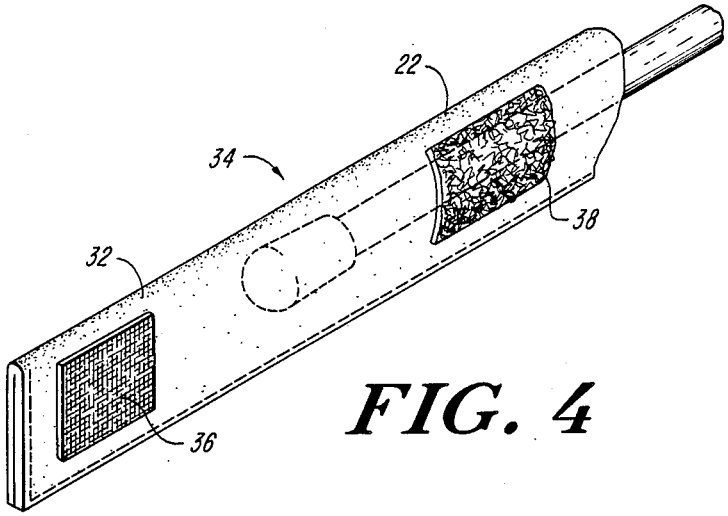
FIG. 4
FIG. 5A
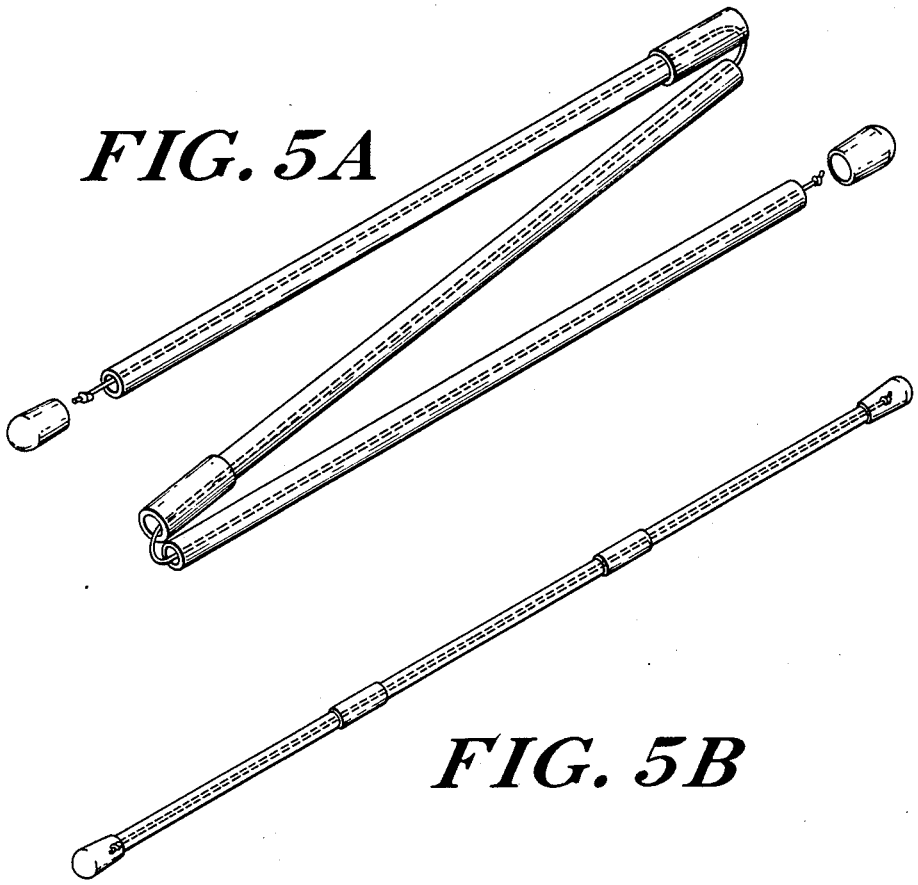
FIG. 5B

CRIB COVER

BACKGROUND OF INVENTION

This invention relates to cribs, playpens and other similar enclosures for infants and children. More particularly, the present invention relates to a safety device for retaining a child within such an enclosure. The present invention is embodied in a tent-shaped safety canopy that is fixable to the top of a conventional crib or playpen, hereafter sometimes referred to as a "pen."

Infants and children generally spend a large amount of time in pen-like structures. Because it is not practical to supervise a child in one of these structures continually, a number of safety devices were developed to prevent the child from climbing or falling out of the pen structure and sustaining an injury.

Although many of the prior art devices accomplish the intended task of retaining the child within the pen, there continues to be a number of inherent limitations in the design of such devices. For example, U.S. Pat. Nos. 3,145,396, 3,546,721, 3,905,056, 4,015,297 and 4,073,017 all disclose various safety canopy means for attachment to either cribs or playpens. The inherent limitation in all the above patents, however, is that the canopy lies directly perpendicular to the side walls of the pen. Therefore, the child or toddler has no headroom after reaching a certain height, and the useful life of such a device is severely limited. Furthermore, the means used to attach these canopy devices to the pen are cumbersome and impractical. Also, only U.S. Pat. No. 3,546,721 of those listed above discloses a canopy in which an access means is provided for reaching the child or infant within the enclosure while keeping the canopy secured in place.

U.S. Pat. No. 3,878,570 discloses a frame-supported canopy for a crib. However, the patented apparatus is made strictly for environmental control of the enclosure and has a use limited to medical applications, as is U.S. Pat. No. 3,905,056 listed above. These devices are designed to strictly control the environment within the canopy enclosure, by preventing passage of oxygen and sound and restricting easy access to the infant.

U.S. Pat. No. 3,344,442 discloses a canopy in the shape of a truncated pyramid, which may be attached to the top of a crib. This structure was designed to provide a safety canopy for use in transporting infants in medical environments. One limitation of this structure is that the canopy is made of a hard plastic material, thereby preventing access to the enclosure except by removing the canopy structure. Removal of the canopy structure requires operation of a special sliding track apparatus which retains the canopy on the crib.

U.S. Pat. No. 4,590,956 discloses a tent-like structure that is attachable to a mattress. Although this particular patent alleviates the problem of headroom for the occupant of the enclosure and does provide access to the enclosed area, the access is not convenient, the apparatus must be affixed to the mattress, and it provides no means for attachment to a playpen.

It is therefore an object of the present invention to provide a safety canopy for pens, which provides adequate headroom for an infant or child and thereby extends the useful life of such a device.

It is a further object of the present invention to provide a safety canopy for pens, which is easily mounted on a crib or playpen.

It is another object of the present invention to provide a safety canopy for pens, which provides means for easy access to the enclosure and which allows the passage of light, sound and air.

SUMMARY OF INVENTION

According to the present invention, a crib cover is provided that comprises an upright canopy portion, means for attaching the canopy portion to a pen-like structure and means for accessing the interior of the enclosure formed by the canopy portion and pen.

According to one embodiment of the invention, a crib cover is provided comprising a tent-like canopy formed of fabric and supported by one or more supporting elements, typically rods, inserted into one or more sleeves attached to the fabric. In this embodiment, the canopy structure is attached to a pen by means of two side panels extending from two sides of a rectangularly-shaped canopy for placement parallel to the end walls of a rectangularly-shaped pen. Each side panel carries straps for fastening the side panels against the pen end walls. This embodiment further includes means for attaching the other sides of the canopy structure to the two remaining sides of the pen. These means preferably are ties with or without Velcro closures, which can be secured to the top of the remaining pen sides. This embodiment also includes a flap opened and closed by a zipper and provided in the top of the canopy accessing the enclosure so that the infant can be placed in or removed from the pen.

BRIEF DESCRIPTION OF DRAWINGS

FIG. 2 is similar to FIG. 1 but showing the canopy of this invention attached to the crib and further showing the means for accessing the interior of the canopy structure;

FIG. 3 is an enlarged perspective fragmented view of a support rod and related canopy structure and showing the manner in which the rod is retained in position;

FIG. 4 is a fragmentary view of one end of one of the sleeve and one rod showing details of the sleeve closure; and FIG. 5A and 5B are perspective views of a shock cord rod in the collapsed and erect positions, used in the frame of the canopy fabric.

DETAILED DESCRIPTION

Figure 1:
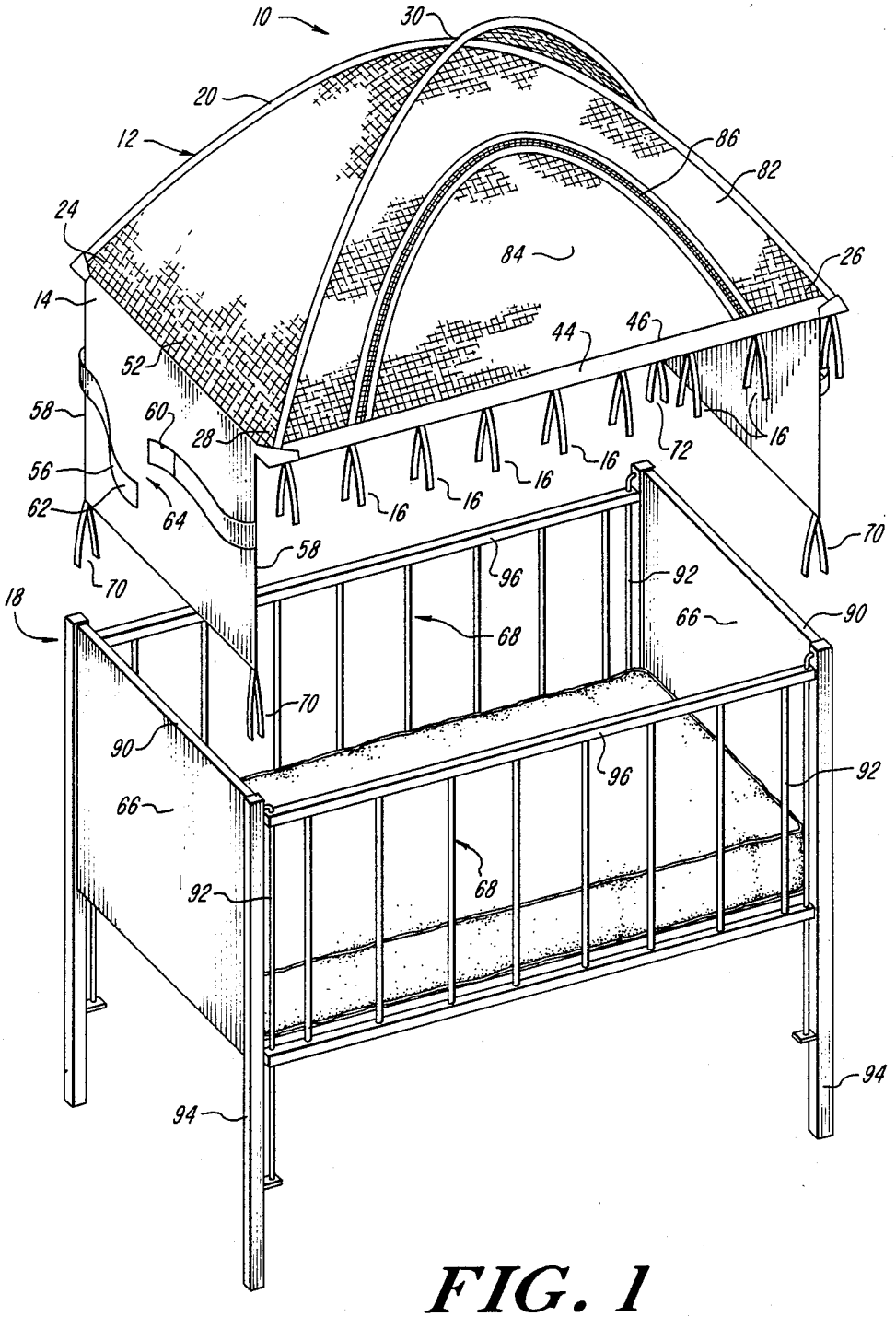
FIG. 1 is a perspective view of the preferred embodiment of the present invention as positioned just prior to attachment to a crib.

The crib cover 10 shown in the drawing includes a canopy 12, panels 14 and side ties 16 as its major components. The crib cover 10 is particularly shaped in the embodiment illustrated to be used with a conventional crib 18 which typically is approximately 2 ½ by 4 ½ feet in plan dimensions. In the preferred embodiment, the canopy 12 is made of a loosely woven fabric or a net material such as six hole polyester netting, which allows for free passage of air, light and sound and which is effectively transparent so that the child may be easily viewed through it when the tent cover is in place. It will, of course, be appreciated that the shape and dimensions of the canopy may be varied to accommodate cribs of other sizes or to be used with playpens or other open top furniture in which infants and toddlers are regularly kept.

The canopy 12 is generally dome-shaped, and a pair of sleeves 20 and 22 which typically may be made of woven pack cloth are stitched to the outside surface of the canopy fabric and extend across the entire fabric from opposite corners. Sleeve 20 is shown to extend between corners 24 and 26 of the canopy while sleeve 22 extends between corner 28 and the fourth corner which is not visible in the perspective views of the drawing. The sleeves 20 and 22 cross at the apex 30 of the canopy, but the stitching securing the sleeves to the fabric does not interrupt the openings extending through the sleeves so that rod-like members may be inserted through the sleeves from one end to the other.

The canopy fabric which is not self-supporting is supported in the dome-like configuration shown by a pair of conventional shock cord rods that extend through the sleeves 20 and 22 from end to end. One shock cord rod is shown in detail in FIG. 5. While shock cord rods are preferable because they may be collapsed for ease of storage or carrying when the crib cover is disassembled, it is evident that continuous one-piece rods may be used to support the canopy cover.

The ends of the sleeves 20 and 22 are open, and each end carries a flap 32 as shown in FIG. 4 which is designed to be folded back upon the sleeve to close the opening. To secure the flap in the closed position shown in FIG. 3, a Velcro closure 34 is provided with mating male and female patches 36 and 38 of the Velcro on the flap and sleeve. The flaps 32 are designed to capture the rods in the sleeve and retain the rods in place when the crib cover is assembled.

A pocket 40 is also formed at each corner of the canopy. The pocket is defined by a generally triangular fabric 42 which may be integral with the panels 14 or the edge fabric 44 stitched to the long side edges 46 of the canopy. The panels 14, edge fabric 44 and pocket fabric 42 may also be made of woven pack cloth. The ends of the sleeves 20 and 22 extend into the pockets 40 so that the pockets serve as boots for the ends of the sleeves and the rods contained in them. Access to the interior of the pocket 40 and the ends of the sleeves 20 and 22 is facilitated by the circular cut-outs 50 provided at the four corners of the canopy, one of which is shown in FIG. 3.

The side panels 14 form extensions of the canopy fabric along its shorter edges 52. The panels 14 carry a pair of straps 54 and 56 stitched or otherwise secured to the side edges 58 of the panels as is clearly evident in FIGS. 1 and 2. The free ends of the straps 54 and 56 carry mating patches 60 and 62 of a Velcro closure 64 so that the straps 54 and 56 may be secured together on the outside of the closed end panels 66 of crib 18 as is more fully described below in connection with the assembly and use of the crib cover.

The ties 16 stitched or otherwise secured to the edge fabric 44 of the canopy 12 are spaced equally along the edges 46. The ties 16 are provided on each long side of the canopy and are intended to secure the canopy to the side rails 68 of crib 18. The ties 16 may simply be knotted together about the side rails to secure the canopy in place, or Velcro closures may be provided on each of the ties for that purpose.

A pair of additional ties 70 are secured to the lower corners of each panel 14. These additional ties may be used in a variety of different ways to secure the lower ends of the panels in place when the erected cover is mounted on the crib.

The crib cover is completed by a large opening 80 in one side 82 of the cover fabric. The opening 80 is closed by a flap 84 preferably made of the same material as the canopy, which may be secured in the closed position by zipper 86 that extends fully about the mating arcuate edges of the canopy fabric and the flap.

When the zipper is closed, the flap 84 forms a part of the side wall 82 of the canopy so that it is essentially uninterrupted. However, when the zipper 86 is opened, the flap 84 may conveniently be folded to the outside of the rail 68 of the crib so as to provide a very large and convenient opening for access to the interior of the crib. The infant or toddler may readily be lifted from or placed in the crib through the opening 80.

The crib cover of the present invention is assembled as follows: First, the shock cord rods are assembled, and each is inserted into one of the sleeves 20 and 22. The rods will flex and assume a bowed configuration when they are both contained in their sleeves because of the domed shape of the canopy fabric. The flaps 32 at the end of each sleeve are then folded over the open ends of the sleeve and are secured in the folded position by the Velcro closures 34. The closed sleeves containing the rods are then placed in the pockets 40 to maintain the rods in the flexed state so that they support the canopy in the dome configuration and maintain tension on the canopy fabric.

After the canopy is erected, it is placed on the top of the crib 18 resting on the top bars 96 of side rails 68 and with the panels 14 disposed against the inside surfaces of the end walls. The canopy preferably is slightly shorter and slightly wider than the crib frame so that it fits readily on top of the rails in that position. The circular openings 50 permit the canopy to sit on the bars 96 without interference from the vertical rods 92 on which the rails 68 are mounted.

The ties 70 at the bottoms of the panels 14 may be secured to the lower ends of the vertical rods 92 mounted on the crib legs 94 and which slidably support the crib side rails 68. With the panels 14 disposed on the insides of the end walls 66, straps 54 and 56 may be pulled about the outside of the end walls 66 and their Velco closures 64 may be secured together so as to securely hold the end panels in place. Thereafter, the ties 16 may be secured together about the top bars 96 of the side rails 68 as suggested in FIG. 2. As stated above, the ties may be knotted together or Velcro closures may be provided on the ties to enable them to be closed about the bars 96.

It will be appreciated that when the crib cover is assembled and mounted on the crib in the manner described, it provides with the crib itself a total enclosure for the infant or toddler, which will deter the toddler from climbing out of or falling from the crib. While the child is confined to the crib, he, nevertheless, may easily be watched for the canopy fabric is essentially transparent. And a window may be provided in the canopy if desired to further facilitate viewing of the child. Furthermore, the canopy does not in any way interfere with the free flow of air through the crib. The open side rails also remain exposed for the free circulation of air and easy viewing of the child. While the child is safely retained in the crib by the crib cover, the child may readily be removed from the crib by merely opening the zipper 86 and folding the flap 84 downwardly on the outside of side rail 68 so as to expose the opening 80 in the canopy fabric. The opening is large enough so that the person attending the child may easily lean into the crib and/or extend both arms into it so as to attend to the child.

While in the foregoing description but a single embodiment of the invention has been illustrated and described, it will be appreciated that numerous modifications may be made of the invention without departing from its spirit. Therefore, it is not intended that the scope of the invention be limited to that single embodiment. Rather, its scope is to be determined by the appended claims and their equivalents.

I claim:

1. An improved safety canopy for a child's pen having end walls and at least two vertically slatted side walls comprising:

a cover fabric and a frame for supporting the fabric in a tent-like configuration on the top of the pen, said fabric having four sides, a pair of side panels secured to and freely depending from two opposite sides of the fabric for extending downwardly from the tops of opposite end walls of the pen substantially into said pen and lying inside the end walls, straps secured to the side edges of the panels and downwardly spaced from the tops of the opposite end walls and the fabric sides for extending about the outside of the end walls for securing the panels in place against the end walls, and ties secured to other opposite sides of the cover fabric for attaching the fabric to the top edges of the slatted side walls of the pen, while leaving the slatted side walls of the pen unobstructed.

2. An improved safety canopy for a child's pen having at least two side rails and two additional sides comprising:

a cover fabric and a frame for supporting said fabric in a tent-like configuration above said pen, a pair of side panels secured to and freely depending from two opposite sides of said fabric for extending downwardly from the tops of the additional sides of said pen substantially into said pen and lying inside those sides while leaving the side rails exposed, and panel fastening means downwardly spaced from the tops of the additional sides and extending about the outside of said additional sides for securing said side panels to the additional sides of said pen to retain the safety canopy in position in the pen.

3. A safety canopy according to claim 2 wherein said panel fastening means comprises straps secured to the side edges of said side panels for extending about the outside of said additional sides for securing said side panels in place against those sides.

4. A safety canopy according to claim 2 further comprising canopy fastening means having a plurality of ties secured to the sides of the fabric above the tops of the side rails for attaching said canopy thereto while leaving said side rails exposed.

5. A safety canopy according to claims 1 or 2 wherein said cover fabric is comprised of a material which allows passage of light, air and sound.

6. A safety canopy according to claim 1 wherein sleeves are attached to the fabric and extend between opposite corners thereof, and rods removably mounted in the sleeves to define the frame for the fabric.

7. A safety canopy according to claim 2 wherein sleeves are attached to the fabric and extend between opposite corners thereof, and rods removably mounted in the sleeves to define the frame for the fabric.

8. A safety canopy according to claim 6 wherein flaps are secured to the ends of the sleeves for closing the rods within the sleeves.

9. A safety canopy according to claim 7 wherein flaps are secured to the ends of the sleeves for closing the rods within the sleeves.

10. A safety canopy as defined in claim 9 wherein an opening with a cover flap is provided in the fabric, said cover flap being attached in part to the fabric by a zipper for providing access to the pen through the fabric.

11. A safety canopy as defined in claim 10 wherein the cover flap is arcuate in shape and may be folded down along the outside of a side rail.

12. A safety canopy as defined in claim 11 wherein pockets are secured to the corners of the fabric and receive the ends of the sleeves and the ends of the rods when the canopy is erected.

13. A safety canopy as defined in claim 6 wherein pockets are provided at the corners of the fabric for receiving the ends of the rods.

14. A safety canopy as defined in claim 1 wherein openings are provided at the corners of the fabric for receiving the upper ends of the slatted side walls when the canopy rests on the side walls.

15. A safety canopy as set forth in claim 1 wherein said straps comprise two straps for each side panel, said straps having first ends secured to opposite edges of each side panel, and said straps extending about the outside of the end walls and having second ends which engage each other for securing the side panels in place against the end walls.

16. A safety canopy as set forth in in claim 2 wherein said panel fastening means comprises two straps for each side panel, said straps having first ends secured to opposite edges of each side panel, and said straps extending about the outside of the end walls having second ends which engage each other for securing the side panels in place against the end walls.

* * * * *